US006467170B2

(12) United States Patent
Kato et al.

(10) Patent No.: US 6,467,170 B2
(45) Date of Patent: Oct. 22, 2002

(54) TUBE FOR HEAT EXCHANGERS AND METHOD OF MANUFACTURING SAME

(75) Inventors: Soichi Kato, Saitama (JP); Muneo Sakurada, Saitama (JP); Shin Kurihara, Saitama (JP); Sadao Haiya, Saitama (JP); Takashi Sugita, Saitama (JP); Shoji Akiyama, Saitama (JP); Takahumi Umehara, Saitama (JP)

(73) Assignee: Zexel Corporation, Tokyo (JP)

( * ) Notice: Subject to any disclaimer, the term of this patent is extended or adjusted under 35 U.S.C. 154(b) by 44 days.

(21) Appl. No.: 09/463,190

(22) PCT Filed: Aug. 6, 1998

(86) PCT No.: PCT/JP98/03513

§ 371 (c)(1),
(2), (4) Date: Jan. 21, 2000

(87) PCT Pub. No.: WO99/08060

PCT Pub. Date: Feb. 18, 1999

(65) Prior Publication Data

US 2001/0049878 A1 Dec. 13, 2001

(30) Foreign Application Priority Data

Aug. 8, 1997 (JP) ..... 9-214882

(51) Int. Cl.[7] ..... B23P 15/26
(52) U.S. Cl. ..... 29/890.049; 29/890.053
(58) Field of Search ..... 165/177; 29/890.049, 29/890.053

(56) References Cited

U.S. PATENT DOCUMENTS 5,186,250 A * 2/1993 Ouchi et al. ..... 165/177
5,697,433 A * 12/1997 Kato ..... 165/177
5,865,243 A * 2/1999 Kato et al. ..... 165/177

* cited by examiner

*Primary Examiner*—I Cuda Rosenbaum
(74) *Attorney, Agent, or Firm*—Kanesaka & Takeuchi

(57) ABSTRACT

A tube for a heat exchanger which is formed to have beads for dividing passages for a medium in the tube by roll forming, wherein base portions of the beads are formed to have a thickness (B) greater than a thickness of a plate material for the tube. The roll forming has a first step of sequentially bending the plate to have a depressed shape to form portions-to-be-bead which are to be intermediate forms of the beads, a second step of performing a width drawing of the portions-to-be-bead and a third step of compressing the portions-to-be-bead, after the second step, in a direction of the height of the beads, wherein a width (w') of the depressions of the portions-to-be-bead (21*a*) in the first step is larger than a width (w) of depressions of beads (21) after forming, and a height (h') of portions-to-be-bead (21*b*) after the second step is determined to be higher than a height (h) of the beads (21) after forming. Thus, the tube for a heat exchanger having a pressure resistance of the base portions of the beads improved and a method for producing the tube for a heat exchanger which can decrease an uneven thickness of the plate when the beads are formed are obtained.

3 Claims, 6 Drawing Sheets

TUBE FOR HEAT EXCHANGERS AND METHOD OF MANUFACTURING SAME

FIELD OF THE INVENTION

The present invention relates to a tube for a heat exchanger in which beads for dividing passages for a medium in tubes are formed by roll forming and a method for producing the same.

BACKGROUND OF THE INVENTION

It is generally known that a parallel flow type heat exchanger has a plurality of tubes laminated with fins alternately interposed therebetween and both ends of the tubes connected to communicate with header pipes, in which a medium for heat exchanging is flown to meander a plurality of times between inlet and outlet joints disposed on the header pipes so to exchange heat with the atmosphere while flowing through the tubes.

Recently, the tubes used for the aforesaid type of heat exchanger are formed by roll forming of a metallic plate material of a strip belt (hereinafter referred to as the plate) into a tube shape having beads for dividing the medium passages, and brazing its required portions.

The roll forming is performed by passing the plate material between a plurality of rotating rolls which respectively have a predetermined shape and are disposed appropriately, and beads are continuously formed on required portions of the plate in a longitudinal direction of the tube. Specifically, the beads are formed by bending the plate to have recessed shapes and have their inwardly protruded tops brazed to opposed portions of the plate so to divide the passage for the medium formed within the tube into a plurality of sections in order to improve a pressure resistance and a heat-exchanging property of the tube.

Generally, the plate in use is a brazing sheet which has a brazing material clad on its entire surface. After assembling the tubes, fins and header pipes into one body by means of a jig and the like, the required portions of the tubes and other required portions of the heat exchanger are brazed by heating the assembled body by one heating operation.

The tube formed by the roll forming as described above is provided with beads 31, 31 at predetermined intervals within a tube 30 as shown in FIG. 6 for example. And, there are disposed joint portions 32, 32 at one end of the formed tube 30 in its breadth direction, and a folding portion 33 at the opposite end in the breadth direction of the tube 30, and the beads 31 and the inside flat surface of the tube 30, and the joint portions 32, 32 are brazed mutually, and respectively.

Thus, a plurality of medium passages 34, 34 divided by the beads 31, 31 are formed within the tube 30.

In the heat exchanger tube formed by the roll forming as described above, the plate used is very thin to suit such conditions as formability, heat-exchanging property and light weight.

Therefore, where the plate is to be formed, it is necessary to suppress the plate from having an unnecessary deviation in thickness (uneven thickness of the plate in section) in order to secure a sufficient pressure resistance for the tube. Specifically, when the plate has any portion having an insufficient thickness owing to the uneven thickness, the pressure resistance of the tube is lowered. Therefore, the occurrence of the uneven thickness must be avoided.

However, the forming of the heat exchanger tube by the conventional roll forming did not take the occurrence of the uneven thickness into consideration, so that an uneven thickness was often formed when the beads were formed, and such an uneven thickness was caused conspicuously when a plurality of beads were formed in the longitudinal direction of the plate.

In the aforesaid type of heat exchanger tube, a larger stress is applied to the roots of the beads, namely the base portions of the beads, in view of the structure. The reason for this is that a stress is concentrated on the base portions of the beads due to the bent shape in the section of the plate.

Therefore, the base portions of the beads had a poor strength as compared with other portions, resulting in a disadvantage that the pressure resistance of the tube is limited.

The present invention was achieved in view of the aforesaid problems. And it is an object of the invention to provide a tube for a heat exchanger with its pressure resistance improved by reinforcing the base portions of beads and a method for producing a tube for a heat exchanger which can decrease an uneven thickness of a plate when the beads are formed.

SUMMARY OF THE INVENTION

The invention described in claim 1 is a tube for a heat exchanger which is formed to have beads for dividing passages for a medium in the tube by roll forming, wherein base portions of the beads are formed to have a thickness greater than that of a plate material for the tube.

Thus, the tube for a heat exchanger according to the invention has the plate at the base portions of the beads made thicker than that of the plate material, so that its pressure resistance can be improved further.

Specifically, the base portion of the bead requires structurally a higher stress as compared with other portions. Therefore, there were conventionally disadvantages that the base portion of the bead had a poor strength, and the pressure resistance of the tube was limited and degraded. But, according to the present invention, the plate is made thick at the base of the bead to reinforce the base of the bead, so that the pressure resistance of the tube can be improved, and the existing drawbacks can be remedied.

The invention described in claim 2 is a method for producing a tube for a heat exchanger which has beads for dividing passages for a medium in the tube formed by roll forming, wherein the roll forming comprises a first step of sequentially bending a flat metal strip plate to have depressions so to form portions-to-be-bead, which are intermediate forms of the beads, a second step of performing a width drawing of the portions-to-be-bead, and a third step of compressing the portions-to-be-bead, after the second step, in a direction of a height of the beads, wherein the portions-to-be-bead formed in the first step having a concave width wider than that of the beads formed from the portions-to-be-bead, and a height of the portions-to-be-bead after the second step is determined to be higher than the height of the beads after the forming.

As described above, according to the method for producing a tube for a heat exchanger according to the present invention, an undesired uneven thickness of the plate involved in the formation of the beads can be decreased, and the tube with the pressure resistance secured can be obtained.

Specifically, it was conventional that the plate was often made to have an uneven thickness when the beads were formed. But, according to the present invention, the portions-to-be-bead having a wider concave width than that of the formed beads are temporarily formed and then drawn, so that the plate can be suppressed from having an uneven thickness when the beads are formed, and the tube can be prevented from having a degraded strength.

And, the portions-to-be-bead are compressed after the drawing, so that the dimensional accuracy of the beads can be improved.

The invention described in claim 3 is a method for producing a tube for a heat exchanger according to claim 2, wherein the thickness of the base portions of the beads in the third step is made greater than the thickness of the plate material for the tube.

Thus, the base of the bead is made thicker than the thickness of the plate material, so that the tube having its pressure resistance further improved can be obtained.

And the increment of increase in thickness of the base of the bead can be obtained by compressing the portion-to-be-bead.

The invention described in claim 4 is a method for producing a tube for a heat exchanger according to claim 2, wherein the beads are formed in three or four, one or two at the center among them are first subjected to the first step, two beads at both ends are then subjected to the first step, and all the beads are subjected to the third step at the same time.

Thus, when three or four beads are formed, the first step is conducted on one or two beads at the center and then on two beads at both ends. Accordingly, the material can be gathered to the center portion in the process of forming the center bead or beads into a concave shape. Therefore, an uneven thickness formed when the aforesaid step is not performed, particularly a situation that the center portion is made thin because of the formation of the center bead or beads, can be prevented. And, when the material is gathered to the center by the first step, a situation that the center portion becomes thin, namely an uneven thickness, is not caused even when the third step is conducted on all the beads at the same time. Therefore, the respective beads can be formed in good balance.

BEST MODE FOR CARRYING OUT THE INVENTION

Embodiments of the invention will be described in detail with reference to the drawings.

Figure 1:
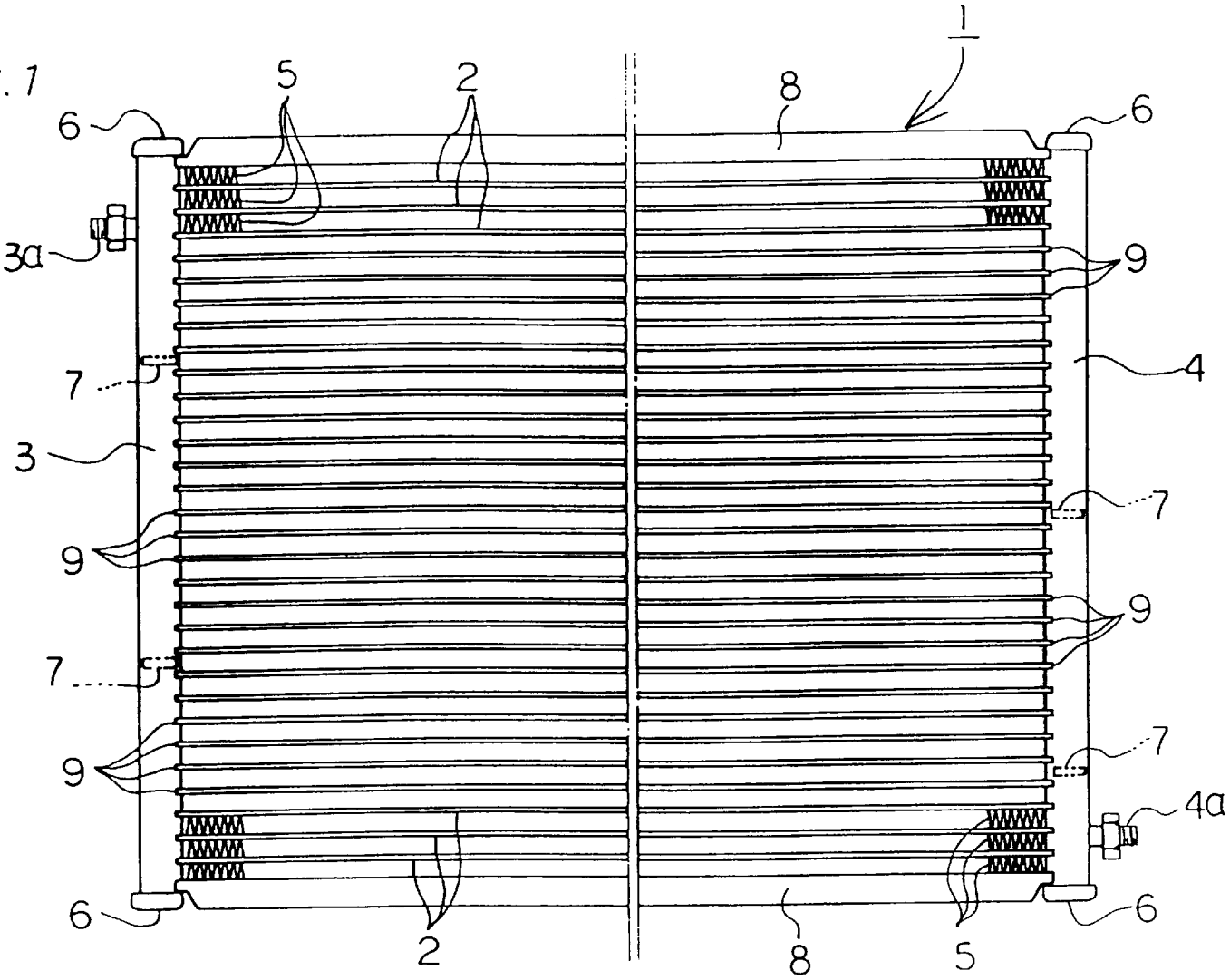
FIG. 1 is a front view showing a heat exchanger according to an embodiment of the present invention.

As shown in FIG. 1, a heat exchanger 1 of an embodiment has a plurality of tubes 2, 2, which are laminated with fins 5, 5 alternately interposed therebetween, connected to communicate with header pipes 3, 4 which are disposed at both ends of the tubes 2,2.

The header pipes 3, 4 are cylindrical pipes which have their top and bottom openings sealed with a blind cap 6 respectively, their interiors being divided by partition plates 7, 7 which are disposed at predetermined positions, and provided with an inlet joint 3*a* to let in a medium and an outlet joint 4a to externally discharge the medium. Tube insertion holes 9, 9 are formed at predetermined intervals along a longitudinal direction of each of the header pipes 3, 4. The tubes 2, 2 have their both ends inserted into and brazed to the tube insertion holes 9, 9. A side plate 8 is placed on the top and bottom of a layer of the stacked tubes 2, 2. The side plate 8 has its ends fixed to the header pipes 3, 4 to reinforce the structural strength of the heat exchanger.

By configuring as described above, the medium taken in through the inlet joint 3*a* is meandered a plurality of times to flow between the header pipes 3, 4 in a predetermined group unit of tubes 2 while heat exchanging and discharged from the outlet joint 4*a*. And the heat exchange by the medium is promoted by an effect of heat conduction of the fins 5 which are alternately interposed between the tubes 2 and also between the side plates 8.

Figure 2:
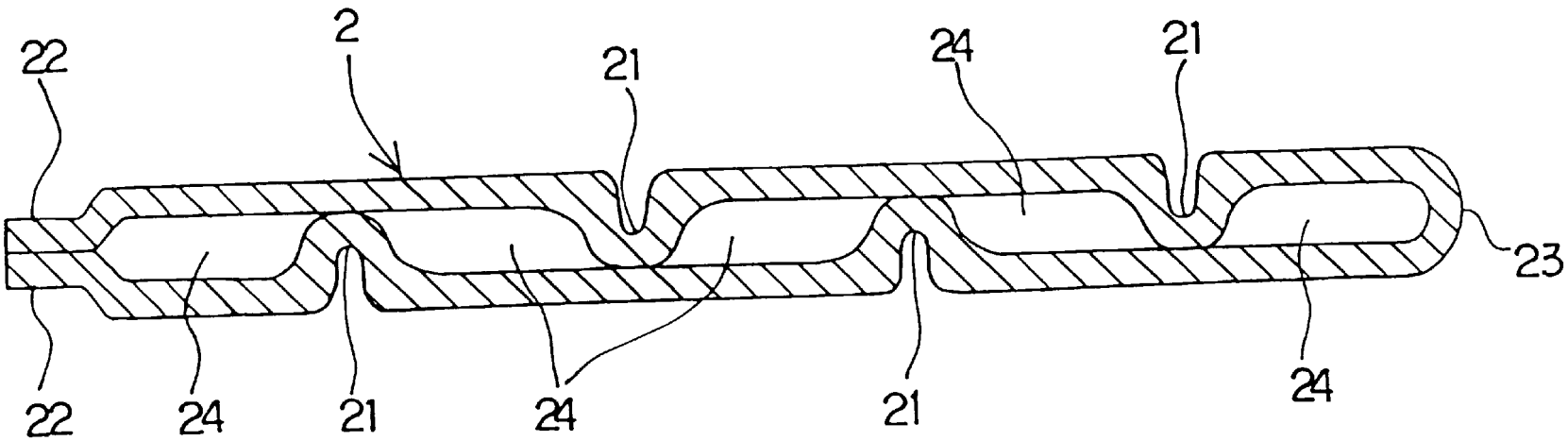
FIG. 2 is a sectional view showing a tube for a heat exchanger according to an embodiment of the present invention.

As shown in FIG. 2, the tube 2 is provided with a plurality of beads 21, 21. These beads 21, 21 are formed by sequentially bending a plate P as shown in FIGS. 3(*a*) to (*d*).

In FIG. 2, 22 is a joint portion, 23 is a folding portion of the plate, and 24 is a passage for a medium. Formation of the beads 21, 21 and the joint portions 22, 22 and folding of the plate are made by roll forming. Specifically, the plate is formed into a predetermined tube shape by being passed between a plurality of rotary rolls disposed to oppose one another.

Figure 3:
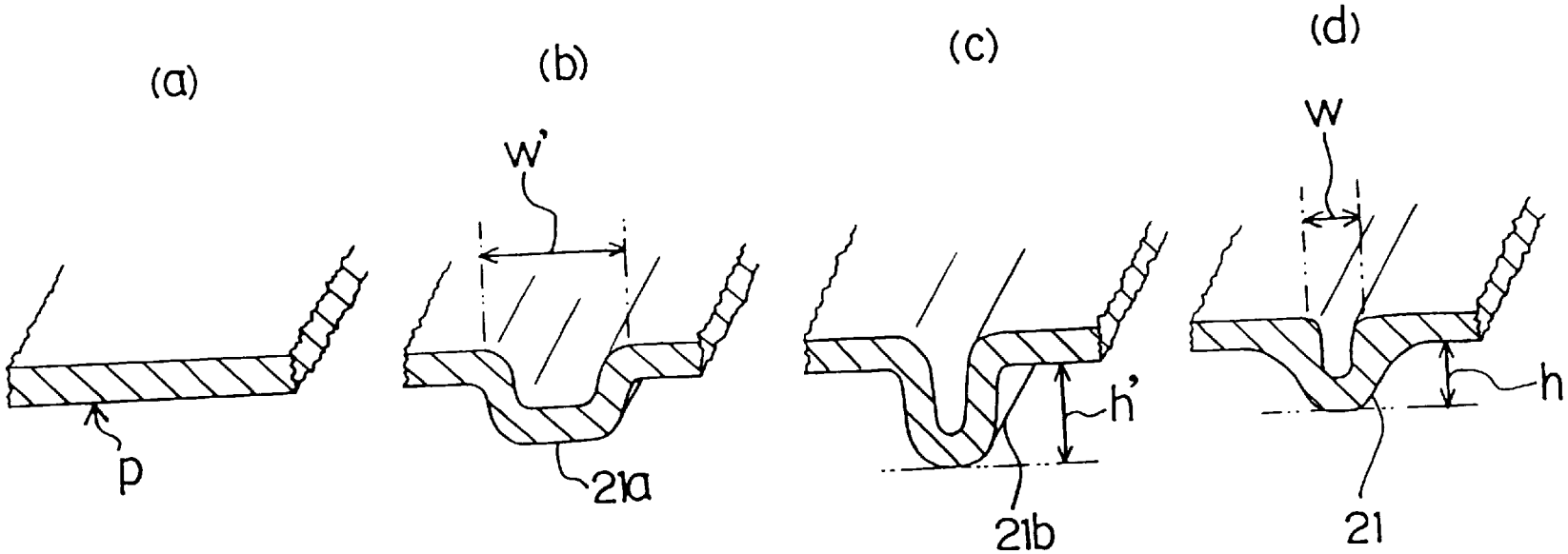
FIGS. 3 (*a*), (*b*), (*c*) and (*d*) respectively show exterior views of a plate, a portion-to-be-bead, a portion-to-be-bead after drawing and a bead.
Figure 4:
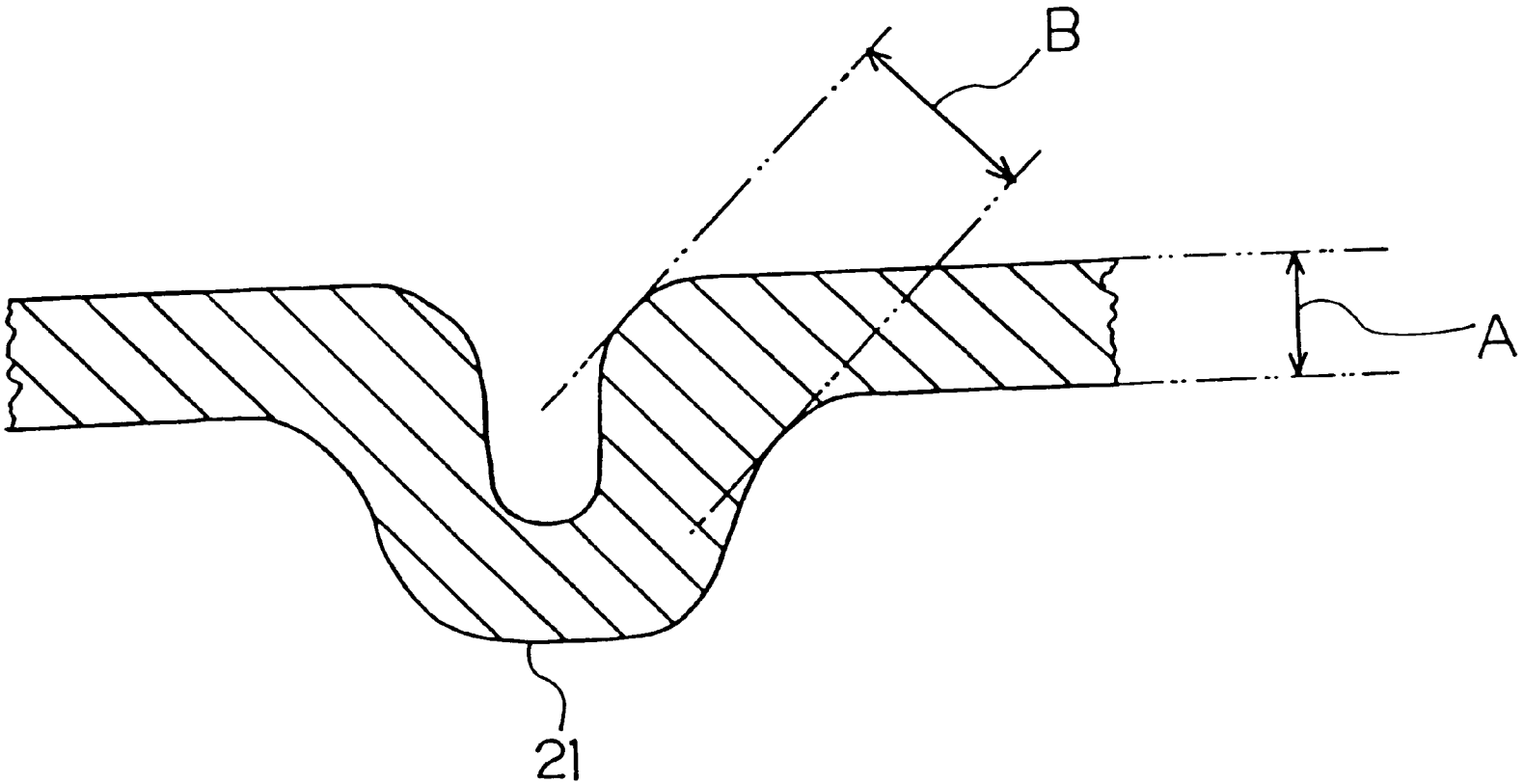
FIG. 4 is a sectional view showing a plate being bent according to an embodiment of the present invention.

In FIG. 2 and FIG. 3, the bead 21 is formed through a first step of forming a portion-to-be-bead 21*a* which is an intermediate form of the bead 21, a second step of width drawing of the portion-to-be-bead 21*a*, and a third step of compressing the portion-to-be-bead 21*b*, after the width drawing, in a direction of the height of the bead.

Specifically, the first step bends the plate P (see FIG. 3(*a*)) at required portions into a concave shape to provide the portion-to-be-bead 21*a* (see FIG. 3(*b*)).

At this time, a concave width w' of the portion-to-be-bead 21*a* is determined to be wider than a concave width w of the formed bead 21.

The second step draws the portion-to-be-bead 21*a* formed by the first step in its breadth direction. At the time of this width drawing, the plate P is drawn to narrow the concave width w' of the portion-to-be-bead 21*a* and to increase a height of the portion-to-be-bead 21*a*. Therefore, the plate P is shrunk in its breadth direction as a whole. And, a height h' of the portion-to-be-bead 21*b*, after the width drawing (see FIG. 3 (*c*)), is determined to be higher than a height h of the formed bead 21. And, the third step forms the bead 21 having the predetermined width w and height h (see FIG. 3(*d*)) by compressing the portion-to-be-bead 21*b*, after the width drawing, in a direction of the height of the bead. And, a change in thickness, which is caused when the portion-to-be-bead 21*b* is compressed, is controlled so to have a thickness B at the base of the bead 21 made thicker than a thickness A of the plate P.

Specifically, the width w' of the portion-to-be-bead 21*a* is changed to the predetermined width w through the second and third steps, and the height h' of the portion-to-be-bead 21*b* after the second step is changed to the predetermined height h through the third step.

Thus, this embodiment forms the portion-to-be-bead 21*a* which has the concave width w' wider than the concave width w of the formed bead 21, performs the width drawing of the portion-to-be-bead 21*a* to form the portion-to-be-bead 21*b* which has the height h' higher than the height h of the formed bead 21, and compresses the portion-to-be-bead 21*b* in the height direction of the bead. Therefore, the formation of an undesired uneven thickness of the plate involved in the formation of the beads can be reduced, and there can be formed a tube with a pressure resistance secured.

And, by utilizing the change in thickness caused at the time of compressing the portion-to-be-bead 21*b*, the thickness B at the base of the bead 21 is formed to be greater than the portion other than the bead 21, or the thickness A of the plate P in this embodiment. Therefore, the existing drawbacks that a stress is concentrated onto the base of the bead due to the bending forming in the section of the plate and the base of the bead has a poor strength as compared with the other portion can be remedied by the bead 21 which has the thickness B of this embodiment. Thus, the pressure resistance of the tube can be improved.

Figure 5:
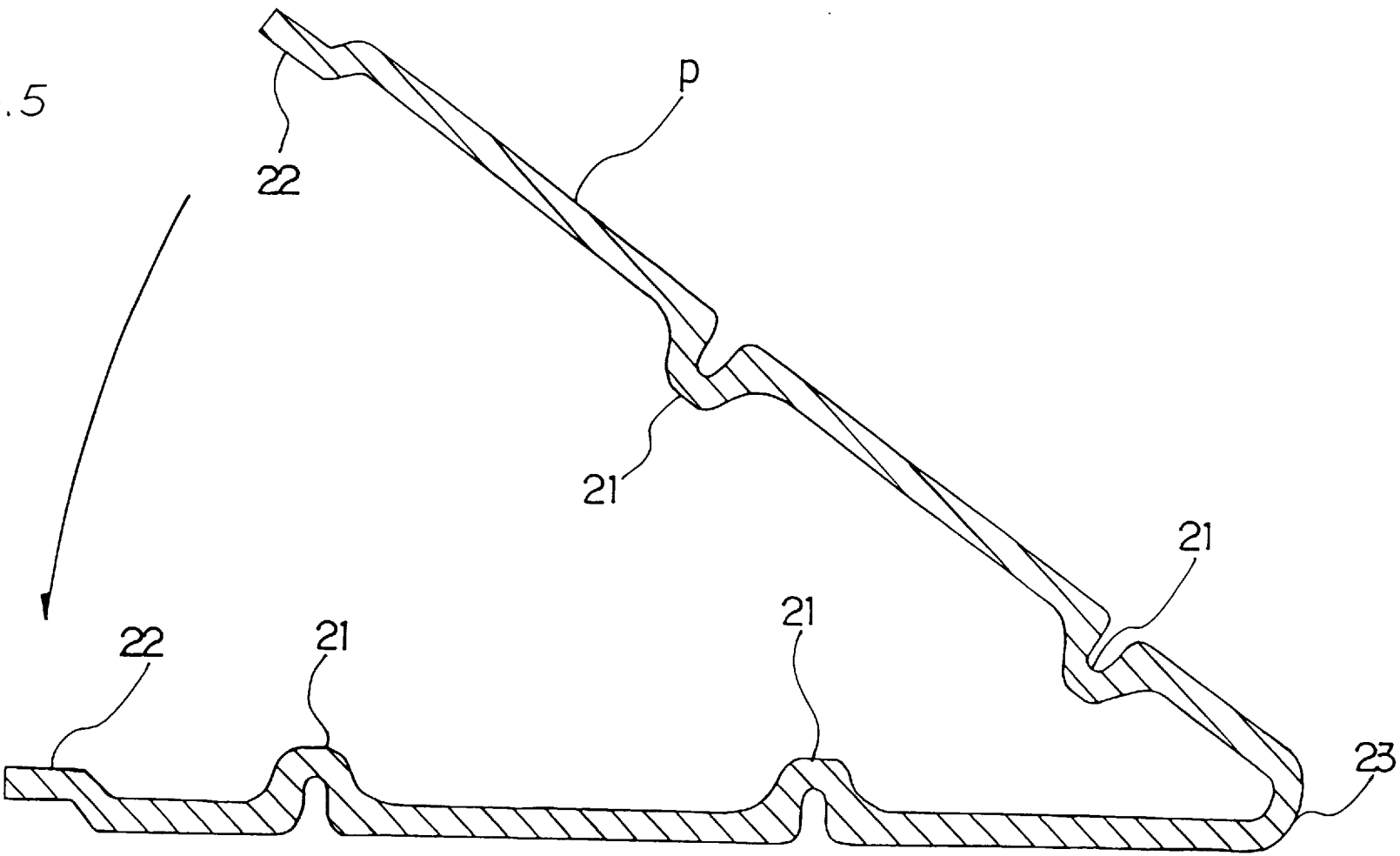
FIG. 5 is a sectional view showing beads according to an embodiment of the present invention.
Figure 6:
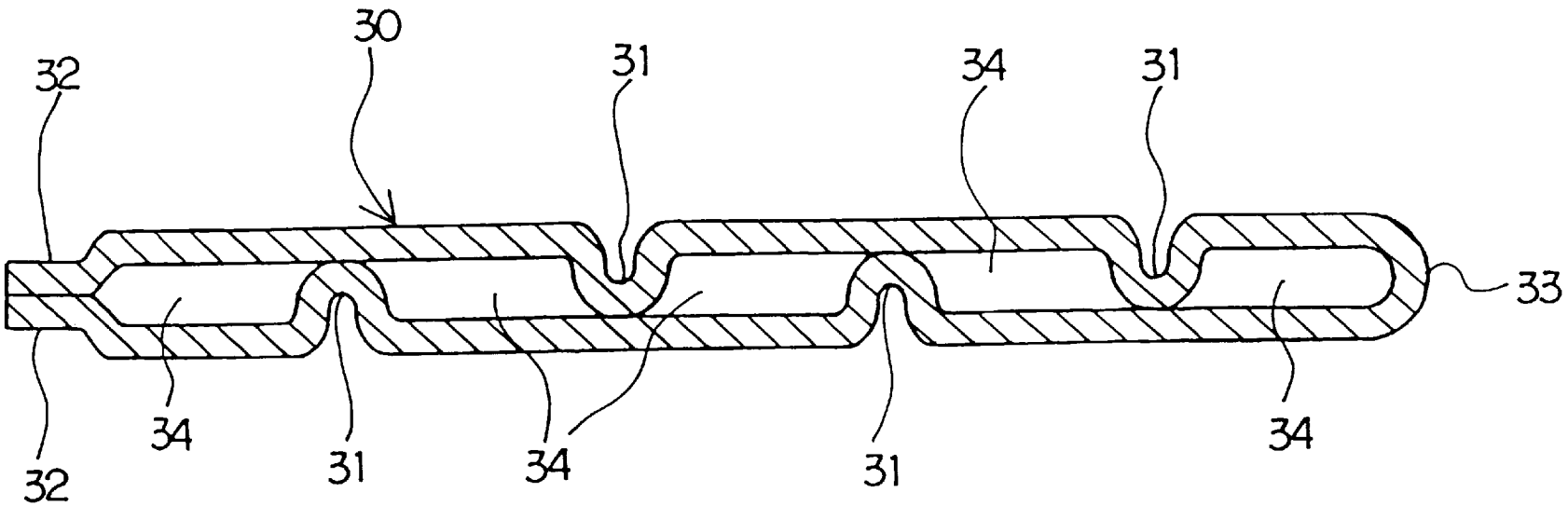
FIG. 6 is a sectional view of a conventional tube for a heat exchanger.

As shown in FIG. 5, the plate P having the beads 21, 21 formed is folded along the center folding portion 23 in the breadth direction of the plate P so that the joint portions 22, 22 which are formed at both ends in the breadth direction of the plate P are mutually joined and brazed. The plate P is folded along the folding portion 23 at a predetermined curvature corresponding to the thickness of the tube 2.

Thus, the tops of the respective beads 21, 21 are brazed with the inside flat surface of the plate P and the joint portions 22, 22 are mutually brazed to form the passages 24, 24 for the medium which are divided by the plurality of beads 21, 21.

The brazing is performed together with the other parts of the heat exchanger by one operation of heat treatment after assembling the tubes 2, 2, the header pipes 3, 4, the fins 5, 5 and other members into one body and conveying the assembled body into a furnace.

Besides, to form the four beads 21, 21 in this embodiment, the first step is first conducted to form the two beads 21 near the center and then the two beads 21 at both ends, and the third step is applied at least to all the beads at the same time.

Specifically, when three beads are formed or four beads are formed as in this embodiment, the first step may be conducted first to form one or two beads at the center and then to form the two beads at both ends. Thus, the material can be gathered to the center in the step of bending the plate to form the bead or beads at the center, and the formation of an uneven thickness caused if the aforesaid step is not conducted, particularly a situation that the center portion becomes thin because of the formation of the bead or beads at the center, can be avoided. And, when the material is gathered to the center in the first step, a situation that the center portion becomes thin, namely an uneven thickness, is not caused even if the third step is simultaneously applied to all the beads. Therefore, the respective beads can be formed in good balance.

As described above, in the method for producing a tube for a heat exchanger of this embodiment, the portion-to-be-bead with a concave width greater than that of the formed bead is formed, and the portion-to-be-bead is subjected to the width drawing and then compressed in a direction of the height of the bead, so that an undesired uneven thickness of the plate involved in the formation of the bead can be decreased, and the tube with its pressure resistance secured can be obtained.

In other words, it was conventionally conspicuous that the plate was caused to have an uneven thickness when the beads were formed. But the present invention can prevent the plate from having an uneven thickness due to the formation of the beads because the portion-to-be-bead having a concave width greater than the formed bead is temporarily formed and subjected to the width drawing. And the tube strength can be prevented from being degraded.

The portion-to-be-bead is compressed after the width drawing, so that the dimensional accuracy of the beads can be improved.

And, the thickness of the bead at the base is greater than that of the plate, so that the tube having its pressure resistance further improved can be obtained.

Specifically, since a greater stress was structurally applied to the base of the bead as compared with the other portions, there were conventionally disadvantages that the base of the bead was poor in strength, and the pressure resistance of the tube was limited and degraded accordingly. But, the present invention can improve the pressure resistance of the tube and remedy the aforesaid disadvantages because the base of the bead is reinforced by increasing the thickness of the base of the bead.

And, the increment of increase in thickness at the base of the bead can be obtained by compressing the portion-to-be-bead.

INDUSTRIAL APPLICABILITY

The present invention is a tube for a heat exchanger having its pressure resistance improved by reinforcing the base portions of beads and a method for producing a tube for a heat exchanger capable of decreasing an uneven thickness of a plate in forming the beads. And, the tube is suitable for a refrigeration cycle for cars requiring a relatively severe pressure resistance.

What is claimed is:

1. A method for producing a tube for a heat exchanger which has beads for dividing passages for a medium in the tube formed by roll forming, wherein the roll forming comprises a first step of sequentially bending a flat metal strip plate to have depressions so to form portions-to-be-bead which are intermediate forms of the beads, a second step of performing a width drawing of the portions-to-be-bead, and a third step of compressing the portions-to-be-bead, after the second step, in a direction of a height of the beads, so to have the portions-to-be-bead in the first step with a concave width wider than that of the beads formed from the portions-to-be-bead, and a height of the portions-to-be-bead after the second step is determined to be higher than the height of the beads after the forming.

2. A method for producing a tube for a heat exchanger according to claim 1, wherein the thickness of the base portions of the beads in the third step is made greater than the thickness of the plate material for the tube.

3. A method for producing a tube for a heat exchanger according to claim 1, wherein the beads are formed in three or four, one or two at the center among them are first subjected to the first step, two beads at both ends are then subjected to the first step, and all the beads are subjected to the third step at the same time.

* * * * *